US011478832B2

(12) United States Patent
Zhao et al.

(10) Patent No.: US 11,478,832 B2
(45) Date of Patent: Oct. 25, 2022

(54) EXTRUSION FORMING DIE FOR CABIN COMPONENT

(71) Applicant: North University of China, Shanxi (CN)

(72) Inventors: Xi Zhao, Shanxi (CN); Shuailing Kan, Shanxi (CN); Zhimin Zhang, Shanxi (CN); Pengcheng Gao, Shanxi (CN); Shuchang Li, Shanxi (CN)

(73) Assignee: North University of China, Taiyuan (CN)

( * ) Notice: Subject to any disclaimer, the term of this patent is extended or adjusted under 35 U.S.C. 154(b) by 0 days.

(21) Appl. No.: 17/077,889

(22) Filed: Oct. 22, 2020

(65) Prior Publication Data

US 2021/0121926 A1 Apr. 29, 2021

(30) Foreign Application Priority Data

Oct. 25, 2019 (CN) ..... 201911024785.5

(51) Int. Cl.
*B21C 23/18* (2006.01)
*B21C 25/02* (2006.01)

(52) U.S. Cl.
CPC ..... *B21C 23/186* (2013.01); *B21C 25/02* (2013.01)

(58) Field of Classification Search
CPC ..... B21C 23/00; B21C 23/0001; B21C 23/18; B21C 23/186; B21C 25/02
USPC ..... 72/267, 257, 266
See application file for complete search history.

(56) References Cited

U.S. PATENT DOCUMENTS

2016/0052035 A1 2/2016 Shatermashhadi et al.

FOREIGN PATENT DOCUMENTS

| | | | |
|---|---|---|---|
| CN | 709603 | A | 12/2005 |
| CN | 103602937 | A | 2/2014 |
| CN | 104588428 | A | 5/2015 |
| CN | 106825098 | A | 6/2017 |
| CN | 108714631 | A | 10/2018 |
| CN | 108889922 | A | 11/2018 |
| JP | 05305381 | A | 11/1993 |
| RU | 2333062 | C2 | 9/2008 |

*Primary Examiner* — Jessica Cahill
*Assistant Examiner* — Smith Oberto Bapthelus
(74) *Attorney, Agent, or Firm* — Dragon Sun Law Firm, PC; Jinggao Li; Nathaniel Perkins

(57) ABSTRACT

The present disclosure provides an extrusion forming die for a cabin component. The extrusion forming die for a cabin component comprises an upper die assembly, a lower die assembly and a combined concave die. The upper die assembly comprises an extrusion punch (3), and the combined concave die comprises an M-shaped outer concave die (4) having a hollow cavity matched with the extrusion punch (3), and a W-shaped inner concave die (5) having a rotary cavity. The W-shaped inner concave die (5) is arranged in the rotary cavity of the M-shaped outer concave die (4) in a matched manner, and the rotary cavity and the hollow cavity are matched to form a rotary extrusion die cavity (18) with a W-shaped longitudinal section.

14 Claims, 4 Drawing Sheets

EXTRUSION FORMING DIE FOR CABIN COMPONENT

The present disclosure claims the priority of Chinese Patent Application No. 201911024785.5, filed to the SIPO on Oct. 25, 2019, titled "Extrusion forming die for cabin component", which is incorporated herein by reference in its entirety.

TECHNICAL FIELD

The present disclosure relates to the technical field of die forming, and in particular to an extrusion forming die for a cabin component.

BACKGROUND OF THE PRESENT INVENTION

Light-weighting has become an urgent need for high-end equipment in aerospace, national defense and military industry, transportation and other fields. As the common basic components, thin-walled cabin components are widely used in high-end equipment. However, as the main load-bearing components, the thin-walled cabin components have higher requirements on mechanical performance. Therefore, it is difficult to meet the light-weighting requirements of high-end equipment due to the impossibility of manufacturing components that can meet the service requirements by light alloys at present.

At present, the most widely used molding technology for manufacturing the cabin components includes the processes of reverse extrusion and machining, which has the advantages of high production efficiency, convenient and easy operation, simple die and so on, but the cabin component manufactured thereby is small in deformation, resulting in lower mechanical performance. A current molding technology adopted for large thin-walled cabin components includes the processes of upsetting, punching, reaming for many times and machining, which has a long production process and increases manufacturing costs. Moreover, the heat generated by repeated extrusion may easily affect the mechanical performance of the final product, resulting in poor consistency of product performance.

In recent years, multi-pass spin forming technology has been widely used in the fabrication of large thin-walled cabin components. Although this technology is widely used, it is only suitable for aluminum alloy and other materials with a wide range of thermal processing temperature, and is easy to cause cracking of magnesium alloy due to the harsh molding conditions, resulting in low yield. Moreover, it is also easy to cause corrugation and other defects in the molding process, making the surface quality of the molded pieces poor. Therefore, it is of great significance to research and develop a new molding method with high performance and short process for large thin-walled cabin components widely suitable for light alloys such as aluminum alloy and magnesium alloy.

A novel molding method for manufacturing a cup-shaped component is disclosed in the Chinese Patent Application No. 201410820158.3, which belongs to the category of severe plastic deformation. Cabin components molded thereby have an average equivalent plastic strain more than 2 times greater than that of traditional cabin components molded by reverse extrusion, and also have small molding load and large deformation, so the method has certain effects on the improvement of grain refinement and mechanical performance of cup-shaped components.

However, it is found through research that the strain distribution and crystal grain distribution of the cabin components molded by the above patent are uneven, and openings of the components are prone to damage, fracture and other defects. In the actual manufacturing process, the yield and material utilization rate may be reduced due to defects such as damage and fracture at the opening of the cabin components.

SUMMARY OF THE PRESENT INVENTION

Thus, the technical problem to be solved by the present disclosure is to provide an extrusion forming die for a cabin component, which can optimize the strain distribution and crystal grain distribution of the cabin component, avoid defects such as damage and fracture at the opening, and improve the yield and material utilization rate.

In order to solve the above problems, the present disclosure provides an extrusion forming die for a cabin component, including an upper die assembly, a lower die assembly and a combined concave die. The upper die assembly includes an extrusion punch, and the combined concave die includes an M-shaped outer concave die having a hollow cavity matched with the extrusion punch, and a W-shaped inner concave die internally having a rotary cavity. The W-shaped inner concave die is arranged in the rotary cavity of the M-shaped outer concave die in a matched manner, and the rotary cavity and the hollow cavity are matched to form a rotary extrusion die cavity with a W-shaped longitudinal section.

In some embodiments, in the longitudinal section passing through a rotation center of the rotary extrusion die cavity, the rotary extrusion die cavity includes an extrusion section, a back pressure section and a shaping section connected successively. The extrusion section includes an upper wall surface which is a stepped differential-velocity extrusion step, and a lower wall surface having a guide slope section connected to the back pressure section; and an included angle formed between the guide slope section and the shaping section is less than or equal to 80 degrees.

In some embodiments, the entire lower wall surface is the guide slope section, and the upper wall surface and the lower wall surface form an opening reduction structure along the direction close to the back pressure section.

In some embodiments, the lower wall surface further includes a stepped differential-velocity extrusion step connected to one end of the guide slope section away from the back pressure section.

In some embodiments, the height of the stepped differential-velocity extrusion step of the lower wall surface is less than that of the upper wall surface.

In some embodiments, a wall section of the stepped differential-velocity extrusion step of the upper wall surface connected to the back pressure section is parallel to the guide slope section.

In some embodiments, an included angle formed between the guide slope section and the shaping section is 75 degrees.

In some embodiments, the M-shaped outer concave die is of an integral structure, and an air passage communicated with the rotary extrusion die cavity is arranged on the M-shaped outer concave die.

In some embodiments, an unloading device, which is adapted to the structure of the rotary extrusion die cavity, is arranged on the top of the W-shaped inner concave die, and a communication passage communicated with the air passage is arranged on the unloading device.

In some embodiments, the unloading device is detachably and fixedly mounted on the top of the W-shaped inner concave die.

The extrusion forming die for a cabin component provided by the present disclosure includes an upper die assembly, a lower die assembly and a combined concave die. The upper die assembly includes an extrusion punch, and the combined concave die includes an M-shaped outer concave die having a hollow cavity matched with the extrusion punch, and a W-shaped inner concave die having a rotary cavity. The W-shaped inner concave die is arranged in the rotary cavity of the M-shaped outer concave die in a matched manner, and the rotary cavity and the hollow cavity are matched to form a rotary extrusion die cavity with a W-shaped longitudinal section. The rotary extrusion die cavity with a W-shaped longitudinal section formed by matching the W-shaped inner concave die with the M-shaped outer concave die may guide the metal extrusion forming process by an extrusion passage of the W-shaped rotary extrusion die cavity obliquely extending upward from a corner, to make the metal first come into contact with a side wall of the W-shaped inner concave die at the corner due to the limitations imposed by an acute angle structure and under the guidance of the oblique extrusion passage at the bottom of the W-shaped rotary extrusion die cavity when the metal reaches the corner during its radial extension from the middle of the W-shaped rotary extrusion die cavity along the extrusion passage at the bottom, and to make metal accumulated in this area under the guidance of the oblique extrusion passage to increase the back pressure, so as to improve the extrusion stress on the opening of the cabin component, reduce the strain difference between the opening and wall of the cabin component and make the entire metal subjected to more uniform equivalent plastic strain, thus effectively realizing uniform crystal grain distribution, avoiding damage and fracture at the opening of the formed piece, and improving the performance and yield of the component to a large extent.

in which:

1: upper die plate; 2: upper die base sleeve; 3: extrusion punch; 4: M-shaped outer concave die; 5: W-shaped inner concave die; 6: lower pad; 7: lower die plate; 8: first screw; 9: ejector bar; 10, first bolt; 11: ejector block; 12: second screw; 13: unloading device; 14: air passage; 15: second bolt; 16: compression spring; 17: third screw; 18: rotary extrusion die cavity; 19: extrusion section; 20: back pressure section; 21: shaping section; 22: stepped differential-velocity extrusion step; 23: guide slope section; 24, through hole; 25: ejector bar through hole; 26: first annular boss; 27: second annular boss; 28: extruded piece; 29: cabin portion; 30: bottom corner; 31: communication passage; 32: rotary cavity; and 33: hollow cavity.

DETAILED DESCRIPTION OF THE PRESENT INVENTION

Figure 1:
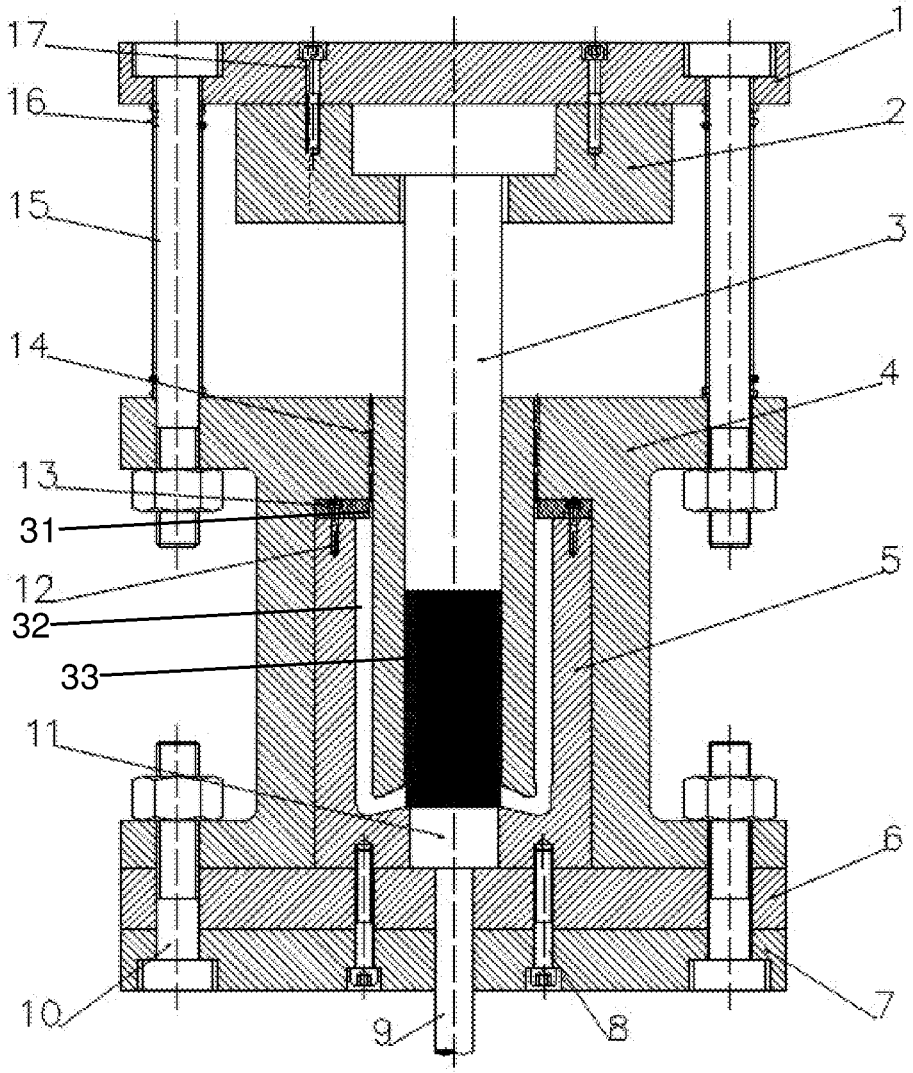
FIG. 1 is a first extrusion forming diagram of an extrusion forming die for a cabin component according to an embodiment of the present disclosure.
Figure 2:
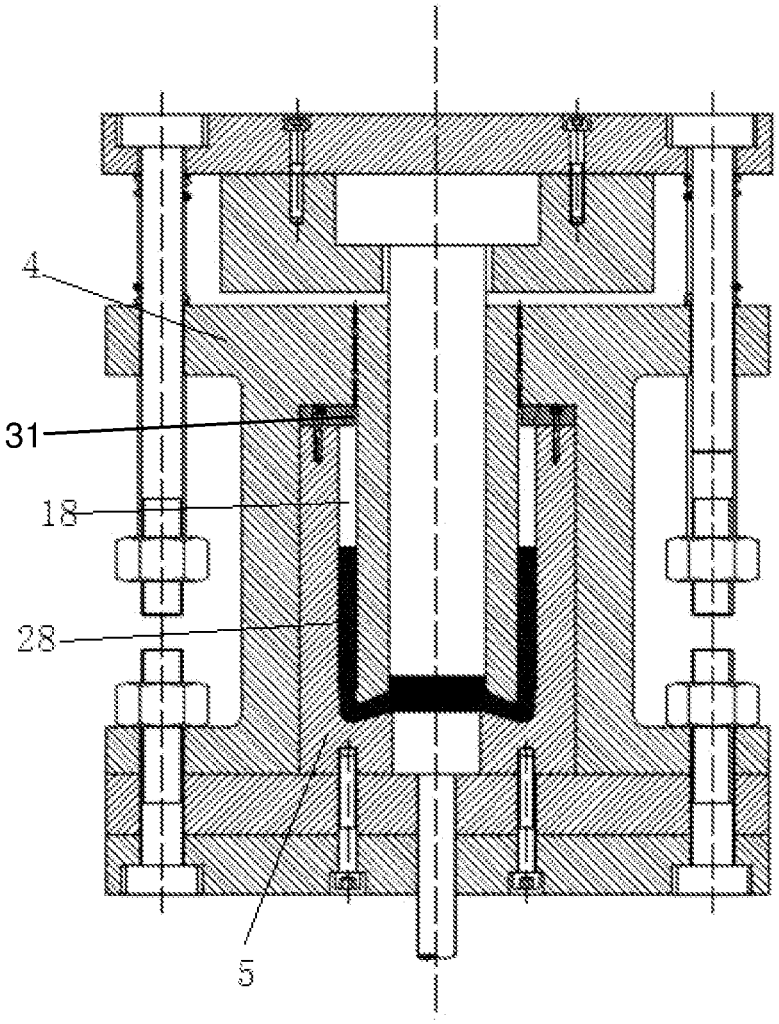
FIG. 2 is a second extrusion forming diagram of the extrusion forming die for a cabin component according to the embodiment of the present disclosure.
Figure 3:
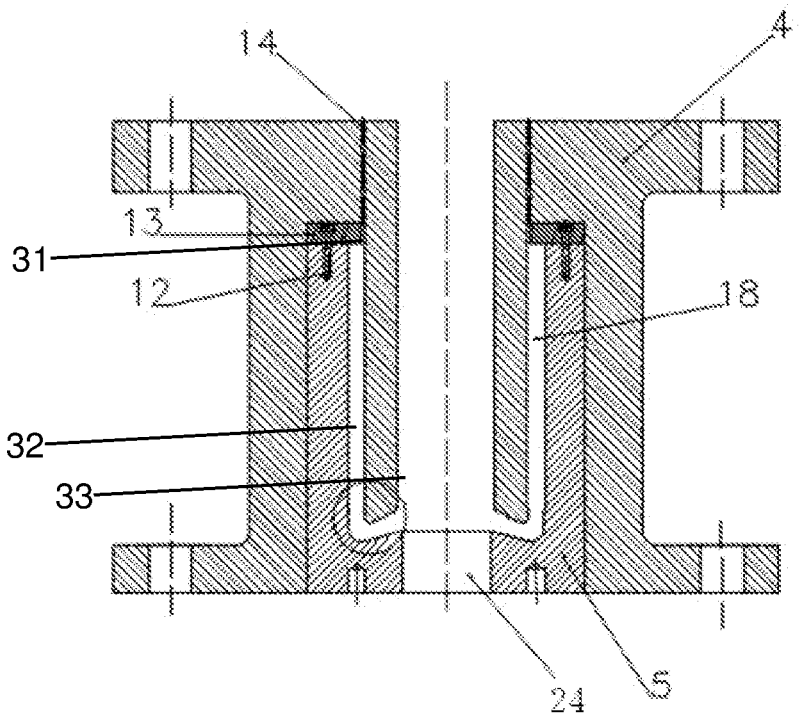
FIG. 3 is an assembly diagram of a combined concave die of the extrusion forming die for a cabin component according to the embodiment of the present disclosure.
Figure 4:
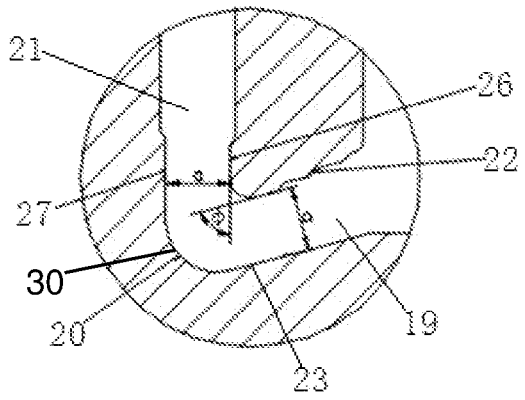
FIG. 4 is a partially enlarged view of a lower end of the combined concave die of the extrusion forming die for a cabin component according to the embodiment of the present disclosure.
Figure 5:
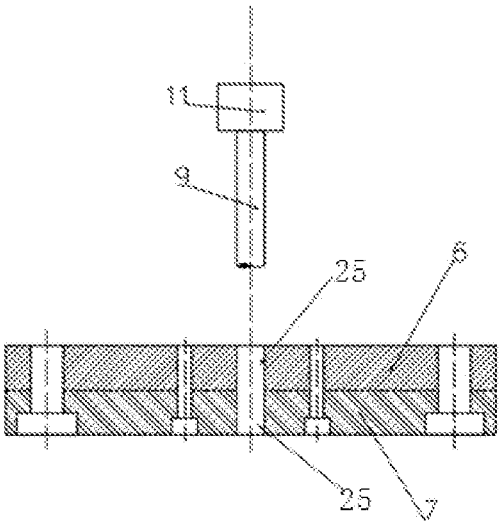
FIG. 5 is an assembly diagram of a lower die assembly of the extrusion forming die for a cabin component according to the embodiment of the present disclosure.
Figure 6:
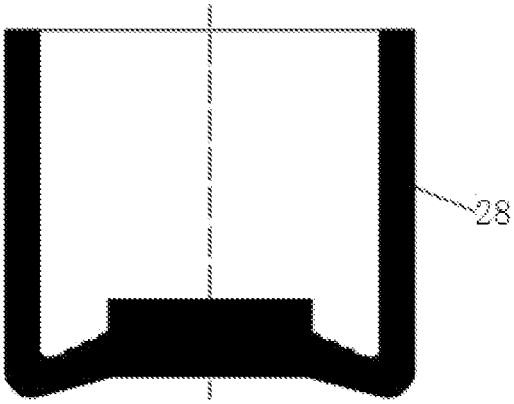
FIG. 6 is a schematic diagram of an extrusion formed component according to the embodiment of the present disclosure.
Figure 7:
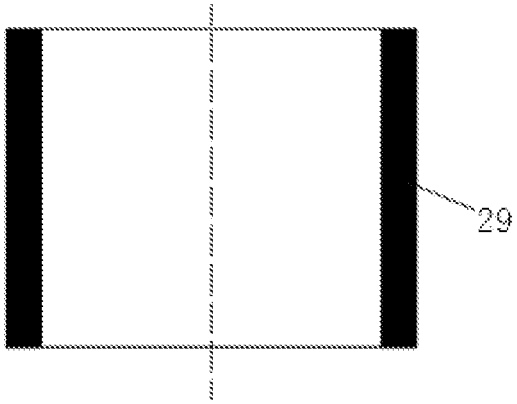
FIG. 7 is a schematic diagram of a thin-walled cabin component according the embodiment of the present disclosure.

With reference to FIGS. 1 to 7, an extrusion forming die for a cabin component according to an embodiment of the present disclosure includes an upper die assembly, a lower die assembly and a combined concave die. The upper die assembly includes an extrusion punch 3, and the combined concave die includes an M-shaped outer concave die 4 having a hollow cavity 33 matched with the extrusion punch 3, and a W-shaped inner concave die 5 having a rotary cavity 32. The W-shaped inner concave die 5 is arranged in the rotary cavity 32 of the M-shaped outer concave die 4 in a matched manner, and the rotary cavity 32 and the hollow cavity 33 are matched to form a rotary extrusion die cavity 18 with a W-shaped longitudinal section.

The rotary extrusion die cavity 18 with a W-shaped longitudinal section formed by matching the W-shaped inner concave die 5 with the M-shaped outer concave die 4 may guide the metal extrusion forming process by an extrusion passage of the W-shaped rotary extrusion die cavity 18 obliquely extending upward from bottom corner 30, to make the metal first come into contact with a side wall of the W-shaped inner concave die 5 at bottom corner 30 due to the limitations imposed by an acute angle structure of bottom corner 30 and under the guidance of the oblique extrusion passage at the bottom of the W-shaped rotary extrusion die cavity 18 when the metal reaches bottom corner 30 during its radial extension from the middle of the W-shaped rotary extrusion die cavity 18 along the extrusion passage at the bottom, and to make metal accumulated in this area under the guidance of the oblique extrusion passage to increase the back pressure, so as to improve the extrusion stress on the opening of the cabin component, reduce the strain difference between the opening and the wall of the cabin component and make the entire metal subjected to more uniform equivalent plastic strain, thus effectively realizing uniform crystal grain distribution, avoiding damage and fracture at the opening of the formed piece, and improving the performance and yield of the component to a large extent.

In some embodiments, the M-shaped outer concave die 4 is of an integrated structure, which can change the stress structure of the M-shaped outer concave die 4 during extrusion forming. In the process of forming a large cabin component, a large floating load generated by the blank on the M-shaped outer concave die 4 will be transferred to a lower die plate 7 through connecting bolts, thus effectively prolonging the service life of the die.

In some embodiments, in the longitudinal section passing through a rotation center of the rotary extrusion die cavity, the rotary extrusion die cavity includes an extrusion section 19, a back pressure section 20 and a shaping section 21 connected successively. The extrusion section 19 includes an upper wall surface which is a stepped differential-velocity extrusion step 22, and a lower wall surface having a guide slope section 23 connected to the back pressure section 20;

and an included angle formed between the guide slope section 23 and the shaping section 21 is less than or equal to 80 degrees. The so-called differential velocity means that there is a misalignment difference in the longitudinal direction between the "step" on the upper wall surface and the lower wall surface of the extrusion section 19.

An "ılı" shaped extrusion cavity is formed by the U-shaped and T-shaped combined concave dies disclosed in the prior art. In the process of forming the cabin component, the metal at the bottom of the blank is directly extruded to finally form the opening of the cabin component. The deformation of this part of the metal is very small, and the subsequent metal is subjected to greater shear stress and strain, which will eventually form the wall of the cabin component. Therefore, there is a large strain difference between the opening and the wall of the formed cabin component, which leads to defects such as damage and fracture at the opening of the cabin component. In addition, there is a large strain gradient and uneven distribution of equivalent plastic strain in the whole cabin component, resulting in the phenomenon of mixed crystal and reducing the product performance to a large extent.

According to the present disclosure, the rotary extrusion die cavity 18, formed by the M-shaped outer concave die 4 and the W-shaped inner concave die 5, is W-shaped. The so-called W-shaped rotary extrusion die cavity 18 adopts a passage corner less than or equal to 80 degrees at the bottom of the rotary extrusion die cavity 18, and forms an extrusion area between the stepped differential-velocity extrusion step 22 on the upper wall surface and the lower wall surface. When flowing the passage corner area where the back pressure section 20 is located during extrusion, the metal at the bottom of the blank forming the opening of the cabin component will first come into contact with the side wall of the W-shaped inner concave die 5 and will be accumulated in this area to form a large back pressure, so as to reduce the metal strain difference between the opening and wall of the cabin component and the strain gradient of the entire formed piece and make the entire metal subjected to more uniform equivalent plastic strain, thus effectively realizing uniform crystal grain distribution, avoiding damage and fracture at the opening of the cabin component, and improving the performance and yield of the component to a large extent.

In one of embodiments, the entire lower wall surface is the guide slope section 23, and the upper wall surface and the lower wall surface form an opening reduction structure along the direction close to the back pressure section 20. The upper wall surface and the lower wall surface form an opening reduction structure along the direction close to the back pressure section 20, to enable the minimum spacing between the upper wall surface and the lower wall surface to be located at a joint of the extrusion section 19 and the back pressure section 20, thus forming a shaping band by using the passages at tail ends of the upper and lower wall surfaces, so that the blank is shaped at the extrusion section 19 before entering the back pressure section 20. Before the blank enters the back pressure section 20, the side wall may produce plastic strain under the extrusion action of the upper and lower wall surfaces. As the extrusion force of the lower wall surface on the blank is greater than that of the upper wall surface on the blank when the upper and lower wall surfaces are symmetrical in structure, it is necessary to design the upper wall surface to increase the extrusion force thereon, so that the extrusion force of the upper and lower walls on the blank is basically the same, and the blank may be subjected to more uniform equivalent plastic strain from the upper and lower wall surfaces, thus effectively realizing grain refinement and uniform distribution. According to the present disclosure, different structural forms are adopted for the upper and lower wall surfaces, so that an asymmetric extrusion area may be formed at the extrusion section 19, and the structural forms of the upper and lower wall surfaces are reasonably designed according to the different extrusion forces of the upper and lower wall surfaces on the blank. When metal flows through this area during extrusion, there is a differential velocity between the metal flowing along the step on the upper wall surface and the metal flowing along the lower surface, so that the upper and lower surfaces of the metal are subjected to shear stress and torque by the step, to ensure that the extrusion force of the upper and lower wall surfaces on the blank is basically the same.

At the same time, as the W-shaped rotary extrusion die cavity 18 is bent at an acute angle at the back pressure section 20, when the blank flows along the extrusion section 19 to the back pressure section 20, it will be accumulated in a passage corner at the back pressure section 20 without coming directly out of the passage corner, so that it may be subjected to sufficient back pressure to change the extrusion strain of the metal at the opening of the cabin component, reduce the strain difference between the metal at the opening and the wall of the cabin component and the strain gradient of the entire formed piece, and make the entire formed piece subjected to more uniform equivalent plastic strain, thus effectively realizing the grain refinement and uniform distribution, avoiding damage and fracture at the opening of the cabin component, and improving the performance and yield of the component to a large extent.

In some embodiments, the lower wall surface further includes a stepped differential-velocity extrusion step 22 connected to one end of the guide slope section 23 away from the back pressure section 20. When the lower wall surface also includes the differential-velocity extrusion step 22, as the guide slope section 23 of the lower wall surface is located at a joint with the back pressure section 20, the guidance of the extrusion section 19 to the blank is not affected, which may ensure that the opening of the cabin component may be accumulated at the back pressure section 20 to form sufficient back pressure. Meanwhile, as both the lower wall surface and the upper wall surface include the differential-velocity extrusion step 22, both sides of the blank may be subjected to large extrusion stress, thus generating sufficient extrusion strain, and improving the equivalent strain uniformity of the blank and grain refinement effect.

In some embodiments, the height of the differential-velocity extrusion step 22 of the lower wall surface is less than that of the upper wall surface. It is also possible to design a stepped differential-velocity extrusion step 22 by taking advantage of the unequal extrusion force of the upper and lower walls, thus making the extrusion strain generated on both sides of the blank more uniform, the grain refinement effect better, and the equivalent plastic strain greater.

In some embodiments, a wall section of the differential-velocity extrusion step 22 on the upper wall surface connected to the back pressure section 20 is parallel to the guide slope section 23, to form a section of extrusion shaping band having the same width a as that of an extrusion sizing band of the shaping section 21, so that the blank may be preformed by the extrusion shaping band, and the final forming effect of the blank may be ensured by the extrusion sizing band.

In some embodiments, an included angle formed between the guide slope section 23 and the shaping section 21 is 75 degrees, which may ensure that the blank is subjected to sufficient back pressure after entering the back pressure section 20 to impose sufficient extrusion strain on the opening of the cabin component, and may also avoid the failure of the blank to enter the shaping section 21 smoothly due to too large angle of bend, affecting the shaping effect of the cabin component.

In the embodiment, the M-shaped outer concave die 4 is of an integral structure, and an air passage 14 communicated with the rotary extrusion die cavity 18 is arranged on the M-shaped outer concave die 4. The air passage 14 communicates the rotary extrusion die cavity 18 with the outside, and may be used as a lubricant passage and an air vent, so as to avoid the air from being retained in the rotary extrusion die cavity 18 to affect the forming effect.

An unloading device 13 adapted to the structure of the rotary extrusion die cavity 18 is arranged on the top of the W-shaped inner concave die 5, and a communication passage 31 communicated with the air passage 14 is arranged on the unloading device 13. The communication passage 31 may ensure the communication between the rotary extrusion die cavity 18 and the air passage 14, so as to ensure the smooth inflow of lubricating oil and the smooth discharge of gas from the rotary extrusion die cavity 18.

In some embodiments, the unloading device 13 is detachably and fixedly mounted on the top of the W-shaped inner concave die 5. In the embodiment, the unloading device 13 is a unloading plate fixedly mounted on a top surface of the W-shaped inner concave die 5 by second screws 12, so that an extruded piece 28 may be unloaded from an inner core of the M-shaped outer concave die 4 during the disengagement of the M-shaped outer concave die 4 and the W-shaped inner concave die 5, thus reducing the difficulty in unloading the extruded piece 28.

In the present disclosure, the upper die assembly is configured to connect to an upper structure of a press, while the lower die assembly is configured to connect to a lower structure of the press.

The upper die assembly includes an upper die plate 1 arranged to an upper portion of the press, and the lower portion of the upper die plate 1 is arranged to an upper die base sleeve 2 and the extrusion punch 3. The upper die plate 1 is fixed on a workbench of the press by a third screw 17. An upper end of the extrusion punch 3 is arranged in the upper die base sleeve 2 and is located on its center line, and the upper die base sleeve 2 is fixed to the upper die plate 1 through hexagon socket screws, so that the extrusion punch 3 is fastened in the upper die base sleeve 2.

The lower die assembly includes a lower pad 6, a lower die plate 7, an ejector bar 9 and an ejector block 11. The lower pad 6 is fixed on the lower die plate 7, and the ejector bar 9 and the ejector block 11 are built in the center line of the lower die plate. An ejector bar through hole communicated with a through hole 24 at the bottom of the W-shaped inner concave die 5 is arranged in the middle of the lower pad 6 and the lower die plate 7 respectively, and the bottom of the M-shaped outer concave die 4 is mounted on the lower pad 6 and the lower die plate 7 by first bolts 10.

The M-shaped outer concave die 4 and the lower pad 6 are fixed on the lower die plate 7 from the top down by the first bolts 10, and the floating force generated by metal on the M-shaped outer concave die 4 in the forming process is transmitted to the lower die plate 7. The W-shaped inner concave die 5 and the lower pad 6 are fixed on the lower die plate 7 from the top down by first screws 8.

The ejector bar through hole 25 communicated with the through hole 24 at the bottom of the W-shaped inner concave die 5 is arranged in the middle of the lower pad 6 and the lower die plate 7 respectively. An upper surface of the ejector bar 9 is connected to the ejector block 11 put at an upper end thereof by screws, and the ejector bar body is put in the ejector bar through hole 25 of the lower pad 6 and the lower die plate 7. The ejector block 11, having an upper surface connected to a horizontal portion of the W-shaped inner concave die 5 and a lower surface put on the lower pad 6, is put in the through hole 24 of the W-shaped inner concave die 5, and is in clearance fit with the inner cavity. The extrusion punch 3, the through hole 24 on the W-shaped inner concave die 5, the ejector bar through hole 25, the ejector block 11 and the ejector bar 9 are located on the same central axis. The ejector bar 9 moves by stretching up and down in the through hole 24 and the ejector bar through hole 25 of the W-shaped inner concave die 5.

An included angle φ of 75 degrees is formed at the back pressure section 20 between the extrusion section 19 and the shaping section 21. At a corresponding position in the longitudinal direction, the M-shaped outer concave die 4 and the W-shaped inner concave die 5 together form an asymmetric extrusion area at the extrusion section 19. A first annular boss is arranged at a lower end of the inner core of the M-shaped outer concave die 4 to form an extrusion sizing band having the inner diameter of the cabin component. At a corresponding position in the transverse direction, a second annular boss 27 is also arranged on an inner side of the W-shaped inner concave die 5 to form an extrusion sizing band having the outer diameter of the cabin component, and the extrusion sizing band is lower than that on an inner side of the M-shaped outer concave die 4 in the longitudinal direction and is tangentially connected to a fillet of the back pressure section 20 at the bottom of the cavity of the W-shaped inner concave die 5.

The upper structure of the press is connected to the upper die base sleeve 2 and the upper die plate 1 by third screws 17. A compression spring 16, located between the upper die plate 1 and the lower die base sleeve, is provided on the second bolt 15, wherein the lower die base sleeve is located on an outer side of the M-shaped outer concave die 4 and is integrally formed with the M-shaped outer concave die 4.

The upper structure of the press is connected to the upper die plate 1 and an upper end of the M-shaped outer concave die 4 by second bolts 15, and a compression spring 16, located between the upper end of the M-shaped outer concave die 4 and the upper die plate 1, is provided on each second bolt 15.

A method for forming a thin-walled cabin component by using the extrusion forming die for a cabin component disclosed by the present disclosure includes the following processes:

(1) Bar cutting.

(2) Homogenizing heat treatment to form a blank.

(3) Forming preparation: The blank is heated to a molding temperature and kept at this temperature, the entire extrusion forming die is preheated to a temperature above the blank molding temperature and kept at this temperature, and the extrusion forming die for the cabin component is assembled on the press. The second bolts 15 connecting the upper die plate 1 and the upper end of the M-shaped outer concave die 4 are unscrewed, and the rise of a slider on the workbench of the press drives the rise of the upper die assembly including the upper die plate 1, the upper die base sleeve 2 and the extrusion punch 3 along with the slider, so that the extrusion punch 3 is disengaged from the inner cavity of the combined concave die. A certain amount of lubricant is injected into the W-shaped rotary extrusion die cavity 18 from an opening of the hollow cavity 33 of the M-shaped outer concave die 4 of the combined concave die, and into the W-shaped rotary extrusion die cavity 18 from the lubricant passage and air passage 14 at the upper end of the M-shaped outer concave die 4. The homogenized treatment blank is put into the hollow cavity 33 of the M-shaped external die 4.

(4) Forming: The extrusion punch 3 extrudes the blank, so that the magnesium alloy blank flows and deforms in the rotary extrusion die cavity 18 with W-shaped section of the extrusion forming die for a cabin component till a component of a desired size is obtained, and the downward movement of the slider on the workbench of the press is stopped.

(5) Unloading: After the end of extrusion forming process, the extruded piece 28 clamps the inner core of the M-shaped outer concave die 4. The second bolts 15 at the joints of the upper end of the M-shaped outer concave die 4 with the lower pad 6 and the lower die plate 7 are unscrewed. The upper workbench of the press drives the extrusion punch 3 to move upwards and disengage from the extruded piece 28, and the upper die assembly drives the M-shaped outer concave die 4 to disengage from the W-shaped inner concave die 5. The extruded piece 28 is unloaded from the inner core of the M-shaped outer concave die 4 during the disengagement, the second screws 12 and the unloading device 13 are removed, and the extruded piece 28 is ejected from the W-shaped inner concave die 5 under the action of an ejector cylinder of the press on the ejector bar 9.

(6) Machining: The bottom of the extruded piece 28 is sawn off from a sawing machine, leaving a desired cabin portion 29.

In the present disclosure, the unloading device 13 is arranged on the upper portion of the W-shaped inner concave die 5. After the end of forming process, the M-shaped outer concave die 4 moves upwards under the action of the press, during which the blank clamping the inner core of the M-shaped outer concave die 4 is unloaded. In the unloading process of this method, the blank is always kept inside the closed die, and the closed die has a heat preservation effect on the blank to make the temperature of the blank drop slowly, so that the blank may be unloaded from the inner core more easily. Furthermore, the device is easy to operate and effectively improves production efficiency.

To sum up, in the present disclosure, the "W"-shaped extrusion cavity and the "step-shaped" asymmetric passage are mainly adopted to extrude large light-weight thin-walled alloy cabin components, so that the material may be subjected to larger and more uniform equivalent plastic strain in the forming process, thus effectively realizing grain refinement and uniform distribution, avoiding damage and fracture at the opening of the formed piece, and greatly improving the performance and yield of the component to a large extent. Therefore, the thin-walled cabin component may be formed by one-time extrusion. Compared with the traditional technology including the processes of upsetting, punching and reaming as well as other disclosed technologies, the technology herein greatly shortens the manufacturing process, reduces the production cost, and ensures the consistency of product performance.

It is readily understood by those of skill in the art that the above advantageous embodiments may be freely combined and superimposed without conflict.

Those described above are merely preferred embodiments of the present disclosure, and are not intended to limit the present disclosure. Any modifications, equivalent substitutions and improvements made without departing from the spirit and principle of the present invention should be included in the protection scope of the present disclosure. Those described above are merely preferred embodiments of the present disclosure. It should be noted that a number of improvements and variations may be made by those of ordinary skill in the art, without departing from the technical principles of the present disclosure, and such improvements and variations should also be considered to fall within the protection scope of the present disclosure.

The invention claimed is:

1. An extrusion forming die, comprising an upper die assembly, an unloading device (13), a lower die assembly and a combined concave die; the upper die assembly comprises an extrusion punch (3), and the combined concave die comprises an M-shaped outer die (4) having a hollow cavity adapted to the extrusion punch (3), and a W-shaped inner die (5) having a cylindrical cavity; the W-shaped inner die (5) is arranged in the cylindrical cavity of the M-shaped outer die (4), and the cylindrical cavity and the hollow cavity combined form a cylindrical extrusion die cavity (18) with a W-shaped longitudinal section;

wherein the cylindrical extrusion die cavity (18) with a W-shaped longitudinal section forms an acute angle at a bottom corner (30) of the cylindrical extrusion die cavity (18), thereby improving performance and yield of an extruded piece (28) produced from the extrusion forming die;

wherein the M-shaped outer die (4) is of an integral structure, and an air passage (14) communicated with outside of the cylindrical extrusion die cavity (18) is arranged on the M-shaped outer die (4);

wherein the unloading device (13) is adapted to a structure of the cylindrical extrusion die cavity (18), and is arranged on a top of the W-shaped inner die (5), and a communication passage (31) communicated with the air passage (14) is arranged on the unloading device (13);

wherein the unloading device (13) is an unloading plate configured to be fixedly mounted on a top surface of the W-shaped inner die (5) by a screw (12); and the communication passage (31) is configured to connect the cylindrical extrusion die cavity (18) to the air passage (14).

2. The extrusion forming die according to claim 1, wherein, in the W-shaped longitudinal section, the cylindrical extrusion die cavity comprises an extrusion section (19), a back pressure section (20) and a shaping section (21) connected successively; the extrusion section (19) comprises an upper wall surface which is a stepped differential-velocity extrusion step (22), and a lower wall surface having a guide slope section (23) connected to the back pressure section (20); and an included angle formed between the guide slope section (23) and the shaping section (21) is less than or equal to 80 degrees;

wherein the guide slope section (23) is a continuous, downward, smooth slope.

3. The extrusion forming die according to claim 2, wherein the entire lower wall surface is the guide slope section (23), and the upper wall surface and the lower wall surface form an opening reduction structure along the direction adjacent to the back pressure section (20).

4. The extrusion forming die according to claim 2, wherein the lower wall surface further comprises a stepped differential-velocity extrusion step (22) connected to one end of the guide slope section (23) away from the back pressure section (20).

5. The extrusion forming die according to claim 4, wherein a height of the stepped differential-velocity extrusion step (22) of the lower wall surface is less than that of the upper wall surface.

6. The extrusion forming die according to claim 2, wherein a wall section of the stepped differential-velocity extrusion step (22) of the upper wall surface connected to the back pressure section (20) is parallel to the guide slope section (23).

7. The extrusion forming die according to claim 2, wherein an included angle formed between the guide slope section (23) and the shaping section (21) is 75 degrees.

8. The extrusion forming die according to claim 1, wherein the unloading device (13) is detachably and fixedly mounted on the top of the W-shaped inner die (5).

9. The extrusion forming die according to claim 8, wherein, in the longitudinal section, the cylindrical extrusion die cavity comprises an extrusion section (19), a back pressure section (20) and a shaping section (21) connected successively; the extrusion section (19) comprises an upper wall surface which is a stepped differential-velocity extrusion step (22), and a lower wall surface having a guide slope section (23) connected to the back pressure section (20); and an included angle formed between the guide slope section (23) and the shaping section (21) is less than or equal to 80 degrees.

10. The extrusion forming die according to claim 9, wherein the entire lower wall surface is the guide slope section (23), and the upper wall surface and the lower wall surface form an opening reduction structure along the direction adjacent to the back pressure section (20).

11. The extrusion forming die according to claim 9, wherein the lower wall surface further comprises a stepped differential-velocity extrusion step (22) connected to one end of the guide slope section (23) away from the back pressure section (20).

12. The extrusion forming die according to claim 11, wherein a height of the stepped differential-velocity extrusion step (22) of the lower wall surface is less than that of the upper wall surface.

13. The extrusion forming die according to claim 9, wherein a wall section of the stepped differential-velocity extrusion step (22) of the upper wall surface connected to the back pressure section (20) is parallel to the guide slope section (23).

14. The extrusion forming die according to claim 13, wherein an included angle formed between the guide slope section (23) and the shaping section (21) is 75 degrees.

* * * * *